US007624876B1

(12) United States Patent
Green

(10) Patent No.: US 7,624,876 B1
(45) Date of Patent: Dec. 1, 2009

(54) PACKAGING ASSEMBLY WITH NON-LINEAR SLOTS

(75) Inventor: Jeffrie Green, Beverly Hills, CA (US)

(73) Assignee: Timely Inventions, LLC, Los Angeles, CA (US)

( * ) Notice: Subject to any disclaimer, the term of this patent is extended or adjusted under 35 U.S.C. 154(b) by 0 days.

(21) Appl. No.: 12/181,211

(22) Filed: Jul. 28, 2008

(51) Int. Cl.
*B65D 5/50* (2006.01)
*B65D 71/12* (2006.01)

(52) U.S. Cl. ..... 206/764; 206/485

(58) Field of Classification Search ..... 206/461–463, 206/467, 470, 471, 485, 526, 564, 565, 756, 206/763–765, 774; 211/41.1, 41.2, 41.14
See application file for complete search history.

(56) References Cited

U.S. PATENT DOCUMENTS

| | | | |
|---|---|---|---|
| 1,727,092 | A | 9/1929 | Bang |
| 2,078,018 | A | 4/1937 | Powell |
| D176,051 | S | 11/1955 | Westernacher |
| D178,312 | S | 7/1956 | Schladermundt et al. |
| 2,874,834 | A | 2/1959 | Woodward |
| 3,009,622 | A | 11/1961 | Leone |
| 3,313,407 | A | 4/1967 | Palm Jr. |
| 3,314,530 | A | 4/1967 | Michalles |
| 3,343,659 | A | 9/1967 | Marondel |
| 3,856,137 | A | 12/1974 | Brindley |
| 3,927,261 | A | 12/1975 | Boyle |
| 3,960,268 | A | 6/1976 | Davis et al. |
| 4,000,811 | A | 1/1977 | Hardison et al. |
| 4,025,039 | A | 5/1977 | Croll et al. |
| 4,450,965 | A * | 5/1984 | Paillet ..... 206/485 |
| 4,485,922 | A | 12/1984 | Desmond et al. |
| 4,582,194 | A | 4/1986 | Karpiloff et al. |
| 4,749,082 | A | 6/1988 | Gardener et al. |
| 4,793,490 | A | 12/1988 | Evert |
| 4,848,577 | A | 7/1989 | Hoffman et al. |

(Continued)

FOREIGN PATENT DOCUMENTS

FR 877412 12/1942

OTHER PUBLICATIONS

The Sale and Use of Certain Assemblies, more than one year prior to Sep. 30, 1997.

*Primary Examiner*—Luan K Bui
(74) *Attorney, Agent, or Firm*—Sheppard, Mullin, Richter & Hampton LLP

(57) ABSTRACT

The present invention provides a packaging assembly for shipping and displaying a plurality of products. The packaging assembly includes a display stand and a plurality of display packs, each configured to hold one or more products. The display stand includes a base panel and left and right side panels projecting upward from the base panel's respective left and right edges. The left and right side panels each define a plurality of slots, with each slot of the left side panel cooperating with a slot of the right side panel to form a plurality of matched pairs of slots, each such matched pair of slots configured to receive at retain one of the display packs. Each slot includes a vertically non-linear section configured such that insertion of a display pack into each matched pair of slots causes the side walls to yieldably deform and thereby secure the display pack in its desired, upright orientation, despite repeated removal and replacement of the display packs by customers.

10 Claims, 6 Drawing Sheets

U.S. PATENT DOCUMENTS

| | | | | |
|---|---|---|---|---|
| 5,069,349 | A | 12/1991 | Wear | |
| 5,097,953 | A | 3/1992 | Gingras | |
| 5,232,102 | A | 8/1993 | Ozawa | |
| 5,363,964 | A | 11/1994 | Hexter, Jr. | |
| D353,092 | S | 12/1994 | Green | |
| 5,529,187 | A * | 6/1996 | DeNola | 206/485 |
| 5,573,117 | A | 11/1996 | Adams | |
| 5,913,426 | A * | 6/1999 | Lotz Renfro et al. | 206/564 |
| 5,979,662 | A | 11/1999 | Green | |
| 6,050,420 | A | 4/2000 | Green | |
| 6,152,305 | A | 11/2000 | Green | |
| 6,367,632 | B1 | 4/2002 | Green | |
| 6,427,842 | B1 | 8/2002 | Green | |
| 2006/0048486 | A1 * | 3/2006 | Laing et al. | 206/485 |
| 2006/0157371 | A1 | 7/2006 | Green | |
| 2006/0163104 | A1 * | 7/2006 | Suzuki et al. | 206/485 |
| 2007/0125678 | A1 | 6/2007 | Green | |
| 2007/0295639 | A1 | 12/2007 | Green et al. | |

* cited by examiner 10
16
14
18
14
4
4
12

FIG. 2B
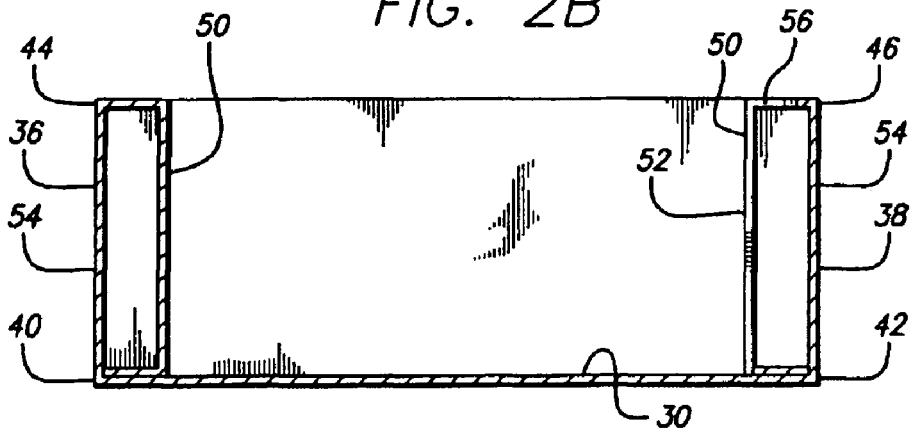
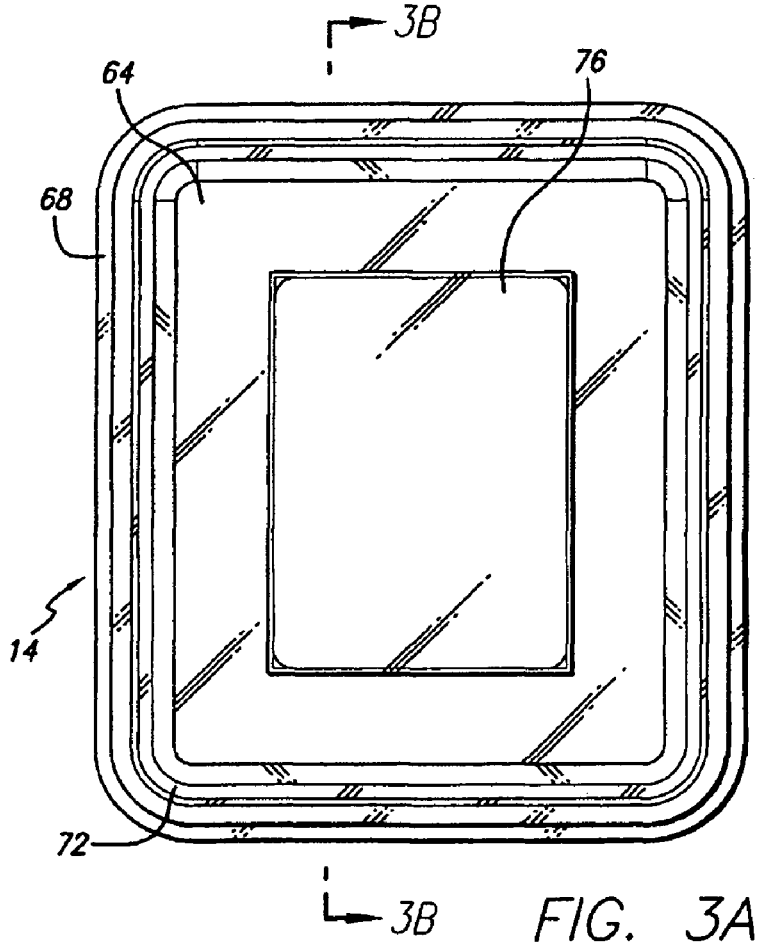
FIG. 3A
FIG. 3B
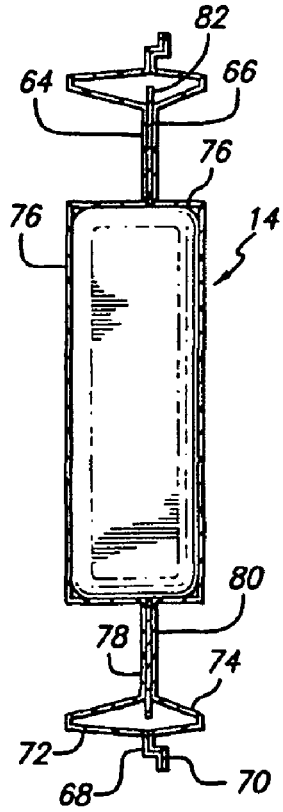

PACKAGING ASSEMBLY WITH NON-LINEAR SLOTS

FIELD OF THE INVENTION

The present invention relates generally to bulk packaging for shipping and display and, more particularly, to a packaging assembly for economically and safely shipping and displaying one or more products.

BACKGROUND OF THE INVENTION

Traditionally, products have been shipped in bulk from a manufacturer to a retailer in cartons containing protective packing material. Individual products were then removed from the cartons to be individually placed on a shelf or rack for display. For small, expensive and easily stolen products, the shelf or rack might be located within a secured display case to minimize the risk of theft.

This system of shipping and display is both costly and time consuming. The manufacturer must often pay relatively expensive initial packaging costs, particularly for items that are easily damaged by rough handling. The retailer must pay employees to individually place each product item on display in a manner that is both visually appealing to the customer and safe for the product. Furthermore, for small, expensive and easily stolen products, which are kept in secured display cases, the retailer must pay a sales person to attend to each customer wishing to inspect the products. These costs are typically passed along to the consumer, who receives little benefit from them other than to receive a product that has safely survived the rigors of shipping. Accordingly, there is a continuing need for more economical means of safely and efficiently shipping and displaying products for sale.

In order to provide for efficient shipping and display, it is known to provide a plurality of the products in a packaging assembly that includes a display stand, a plurality of display packs holding the plurality of products, and a shipping cover. U.S. Pat. No. 5,979,662, which is incorporated herein by reference, describes such a packaging assembly. The display stand is preferably constructed from a single sheet of cardboard, and it includes a rectangular base panel, a front panel having a gap for viewing, and two parallel side panels. Each side panel includes a plurality of slots that align with slots in the other side panel.

The display pack, which contains the product within its smaller packaging, typically is significantly larger than the small packaging, providing for increased deterrence of theft. Typically, display packs are configured with an appealing appearance to the customer, and provide added safety in shipping.

Display packs are usually approximately planar assemblies formed from front and rear portions of transparent, vacuum-molded plastic. The front and rear portions are each configured with a flange, the flanges each forming conforming notches allowing the two portions to be adjoined and heat sealed or glued together. The display stand's matched pairs of slots are configured to receive the display pack flanges to support and display the products carried in the product chamber. The display packs are inserted into succeeding matched pairs of the slots. Optionally, the front and rear portions include frames configured to abut with the frames of adjacent display packs, to provide structural support to each succeeding display pack.

Such display packs are relatively inexpensive, and benefit from the appealing appearance of the small packaging, which is visible through the display packs. For example, U.S. Design Pat. No. D353,092, to Green, entitled "Blister Pack," discloses a transparent display pack assembly having several cavities for containing products.

The display stand of the packaging assembly, with the plurality of inserted display packs, may be covered with a shipping cover to provide a structurally sound rectangular box suitable for shipping. The shipping cover is a conventional, five-sided, open-topped, rectangular box, having an opening that conforms to the shape and size of the base panel, allowing the shipping cover to be taped, along its opening, to the under side of the display stand's base panel. As an alternative to using a shipping cover, a plurality of display stands, each with their plurality of inserted display packs, can be stacked, palletized and wrapped.

This display assembly provides many advantages, some of which are described in the above referenced utility patent. One of these advantages is that the packaging assemblies can be designed in standard sizes so that stores can designate standard increments of shelf space, regardless of the size of the product. Another of these advantages is that the plurality of display packs provide a strong and resilient inner support structure for the box formed by the display stand and the shipping cover. The stronger this structure is, the better suited the packaging assembly is for shipping.

One disadvantage of prior shipping assemblies of this kind is that, over time, the portions of the left and right side panels forming the slots for supporting the display packs can become bent and lose sufficient integrity to support the display packs in their desired, substantially upright orientation. This can be a particular problem if customers repeatedly remove and replace a display pack in a matched pair of slots. As a result, the display packs can tilt forward or rearward and fail to attract further customers in the manner desired.

It should, therefore, be appreciated that there exists a need for an improved packaging assembly that overcomes the drawbacks of prior packaging assemblies, and that can better support a plurality of display stands in their desired upright positions despite repeated removal and replacement of the display packs by customers. The present invention fulfills this need and provides further related advantages.

SUMMARY OF THE INVENTION

The present invention provides a packaging assembly for shipping and displaying a plurality of products. It includes a display stand and a plurality of display packs, each carrying one or more products and each supported in a substantially upright, attractive orientation despite repeated removal and replacement by customers within the display stand, all without requiring the attention of a salesperson.

More particularly, each of the plurality of display packs includes a generally planar periphery, with the one or more products visible in a middle portion. The display stand includes a base panel and left and right side panels projecting upward from the base panel's respective left and right edges. The left and right side panels each define a plurality of slots, with each slot of the left side panel cooperating with a slot of the right side panel to form a plurality of matched pairs of slots for receiving and retaining the plurality of display packs. In addition, at least one slot of each matched pair of slots includes a vertically non-linear section configured such that the insertion of a display pack into the pair of slots causes the portion of the side wall defining the non-linear section to yieldably deform and thereby retain the display pack in its desired, upright orientation.

In other, more detailed features of the invention, the plurality of display packs all are sized and configured to project above the upper ends of the left and right side panels when the display packs are received in matched pairs of slots defined in the side panels. In addition, each slot includes a vertically non-linear section configured such that the insertion of a display pack into the matched pair of slots causes the side walls defining both vertically non-linear sections to yieldably deform and thereby retain the display pack in a desired, upright orientation.

In a preferred embodiment, the vertically non-linear sections of all of the plurality of matched pairs of slots have a smoothly curved shaped. In addition, each of the plurality of slots defined in the left and right side panels further includes an upper vertical section located above the vertically non-linear section and a lower vertical section located below the vertically non-linear section. Preferably, each of the plurality of slots defined in the left and right side panels has a prescribed, substantially uniform horizontal width, and the vertically non-linear section of each slot deviates from vertical by a horizontal distance less than the slot's prescribed, substantially uniform horizontal width. In addition, each slot's prescribed, substantially uniform horizontal width is preferably substantially the same as the thickness of the portion of the display pack that is received and retained by the matched pair of slots.

In other more detailed features of the invention, the display stand's base panel, left side panel, and right side panel all are defined by a single piece of folded cardboard. The left side panel includes an outer wall, an upper wall, and an inner wall, and the plurality of slots defined in the left side panel are located in the panel's inner wall and upper wall; similarly, the right side panel includes an outer wall, an upper wall, and an inner wall, and the plurality of slots defined in the right side panel are located in the panel's inner wall and upper wall. Preferably, the single sheet of folded cardboard is E-flute or F-flute corrugated cardboard, configured such that the flutes are oriented substantially horizontally in the left and right side panels. The display packs all are sized and configured to project above the upper ends of the left and right side panels. These features advantageously provides for economical construction of a base stand that is aesthetically pleasing and that facilitates excellent customer viewing of the display packs.

Other features and advantages of the invention should become apparent from the following detailed description of the invention, taken in conjunction with the accompanying drawings, which illustrate, by way of example, the principles of the invention.

BRIEF DESCRIPTION OF THE DRAWINGS

Embodiments of the present invention will now be described, by way of example only, with reference to the following drawings, in which:

FIG. 2B is a cross-sectional, front elevational view of the display stand depicted in FIG. 2A, taken along line 2B-2B of FIG. 2A;

FIG. 3A is a front elevational view of a display pack included in the packaging assembly depicted in FIG. 1;

FIG. 3B is a cross-sectional, side elevational view of the display pack depicted in FIG. 3A, taken along line 3B-3B of FIG. 3A;

DETAILED DESCRIPTION OF THE PREFERRED EMBODIMENTS

Figure 1:
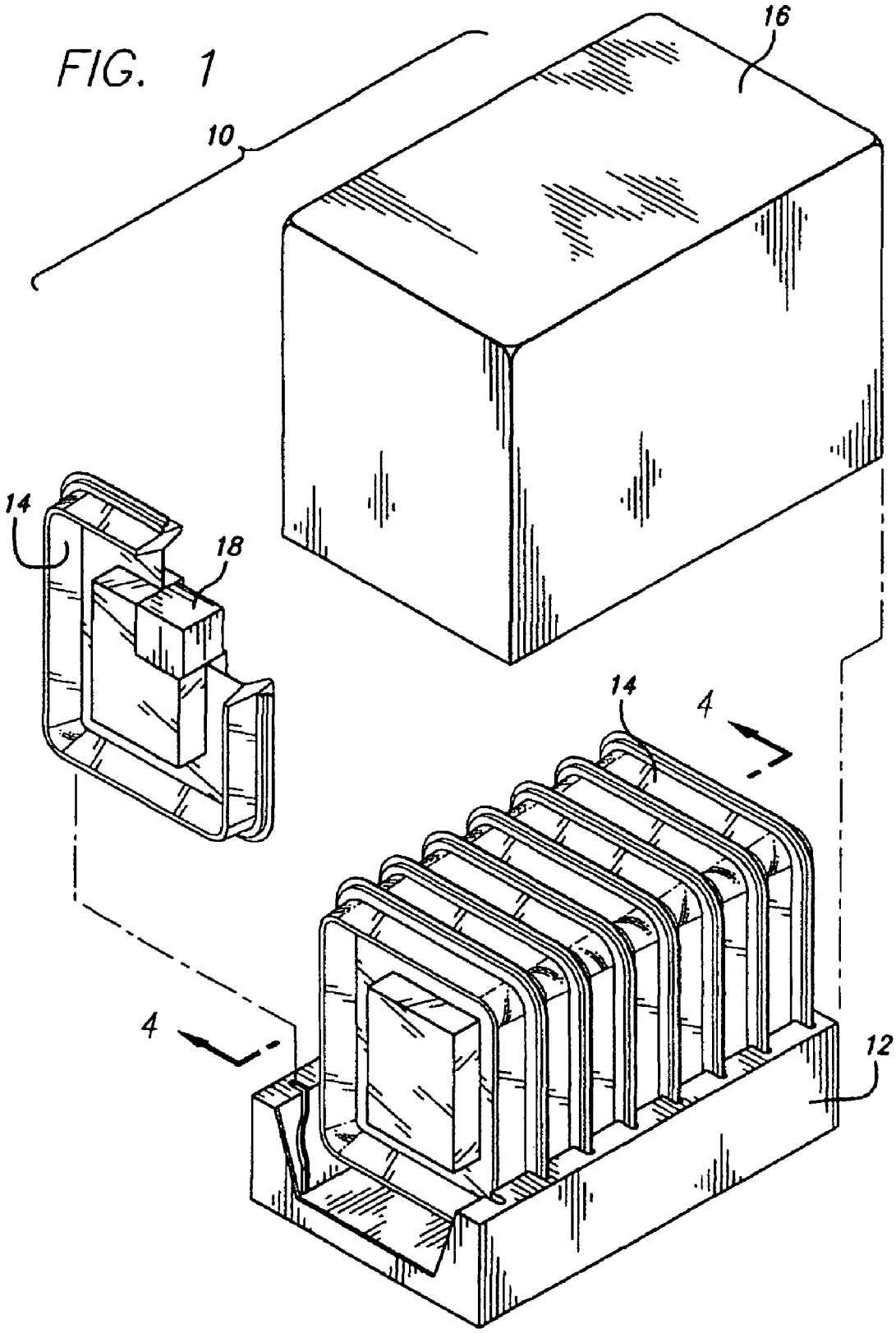
FIG. 1 is an exploded perspective and partially cut-away view of a packaging assembly, in accordance with the principles of the present invention.

With reference now to the exemplary drawings, and particularly to FIG. 1, there is shown a packaging assembly 10 according to the present invention. The assembly includes a display stand 12, a plurality of display packs 14, and a shipping cover 16. Each display pack is configured to contain one or more packaged products 18 for both shipping and display.

Figure 2A:
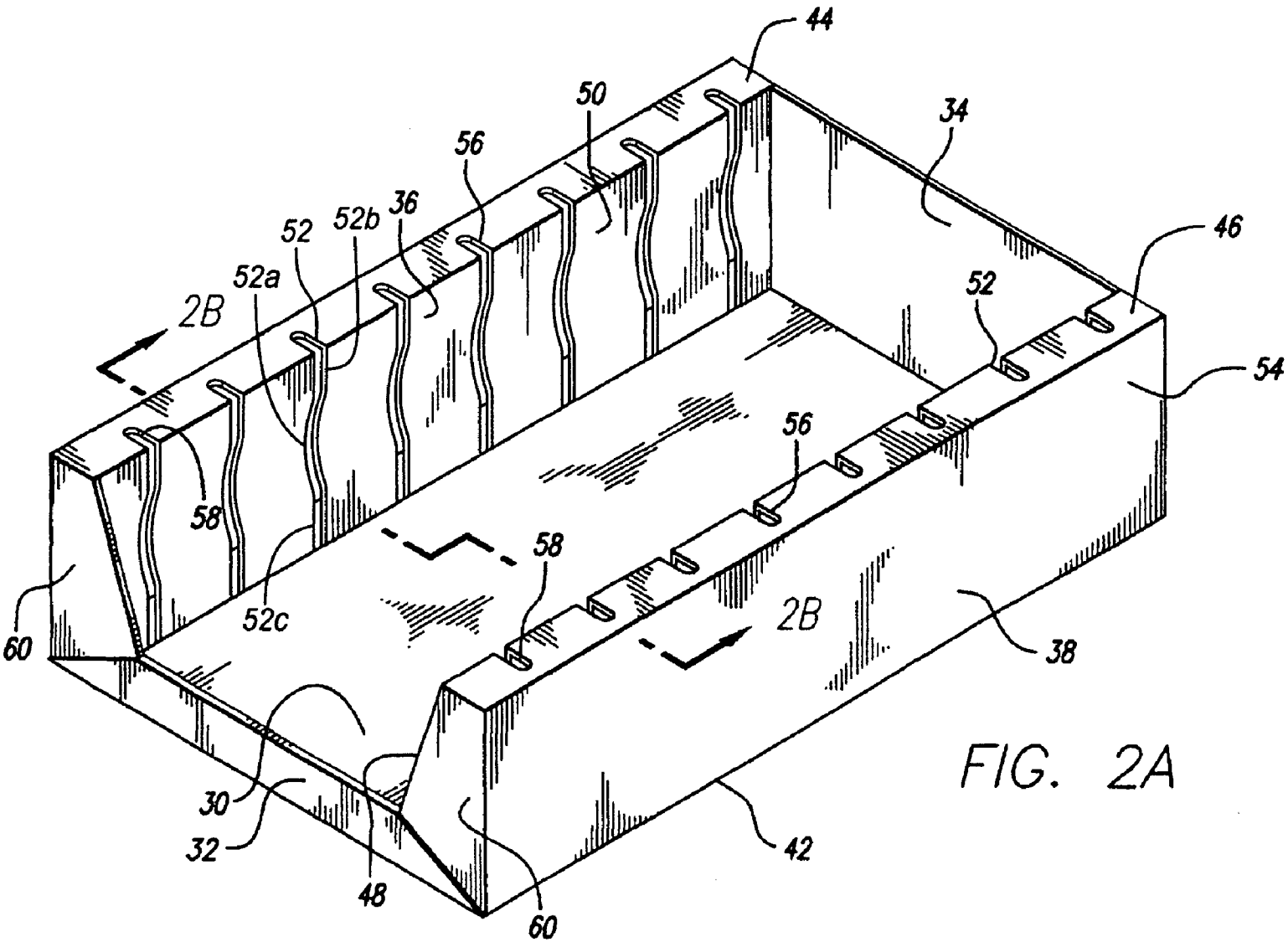
FIG. 2A is a perspective view of a display stand included in the packaging assembly depicted in FIG. 1.

As seen in FIGS. 2A and 2B, the display stand includes a rectangular base panel 30 having a front edge, a rear edge opposite the front edge, a left side edge, and a right side edge. The left and right side edges are parallel to each other, extending between the front and rear edges on opposing sides of the base panel. A front panel 32, a rear panel 34, a left-side panel 36, and a right-side panel 38 project upward from the front edge, rear edge, left side edge and right side edge, respectively. The front, rear, left-side, and right-side panels interconnect to form four walls around the base panel. The side panels lie in parallel planes, normal to the plane of the base panel.

The left-side panel 36 and the right-side panel 38 are rectangular, having lower ends 40, 42, respectively, and upper ends 44, 46, respectively. The lower end of the left side panel adjoins the left side edge of the base panel 30. Likewise, the lower end of the right side panel adjoins the right side edge of the base panel. The rear panel 34 is rectangular, extending between the left and right side panels at their rear ends. Similarly, the front panel 32 is rectangular, extending between the left and right side panels at their front ends. The front panel is preferably the same height as the rear panel, but preferably defines a substantial gap 48 for viewing the display packs.

Each side panel 36, 38 includes a plurality of sections that form walls of the side panel. An inner wall 50 of each side panel, facing the other side panel, defines a plurality of slots 52 that each start at the upper end 44, 46 of the side panel and extend toward the lower end 40, 42 of the side panel. An outer wall 54 of the side panel faces away from the other side panel and preferably does not include slots. The upper end of the panel forms slot ends 56 that define a useable depth for the inner-wall slots. Each slot 52 in the left-side panel 36 has a matched slot in the right-side panel 38, and vice versa, forming matched pairs of slots. Matched pairs of slots 58 run parallel to each other, and preferably are symmetrically located in the display stand 12.

Each slot includes a vertically non-linear section 52*a*, which may extend toward the front or rear panel. In a preferred embodiment, each slot includes a vertically linear top section 52*b*, a vertically linear bottom section 52*c*, and a vertically non-linear section between the top and bottom sections.

Figure 2C:
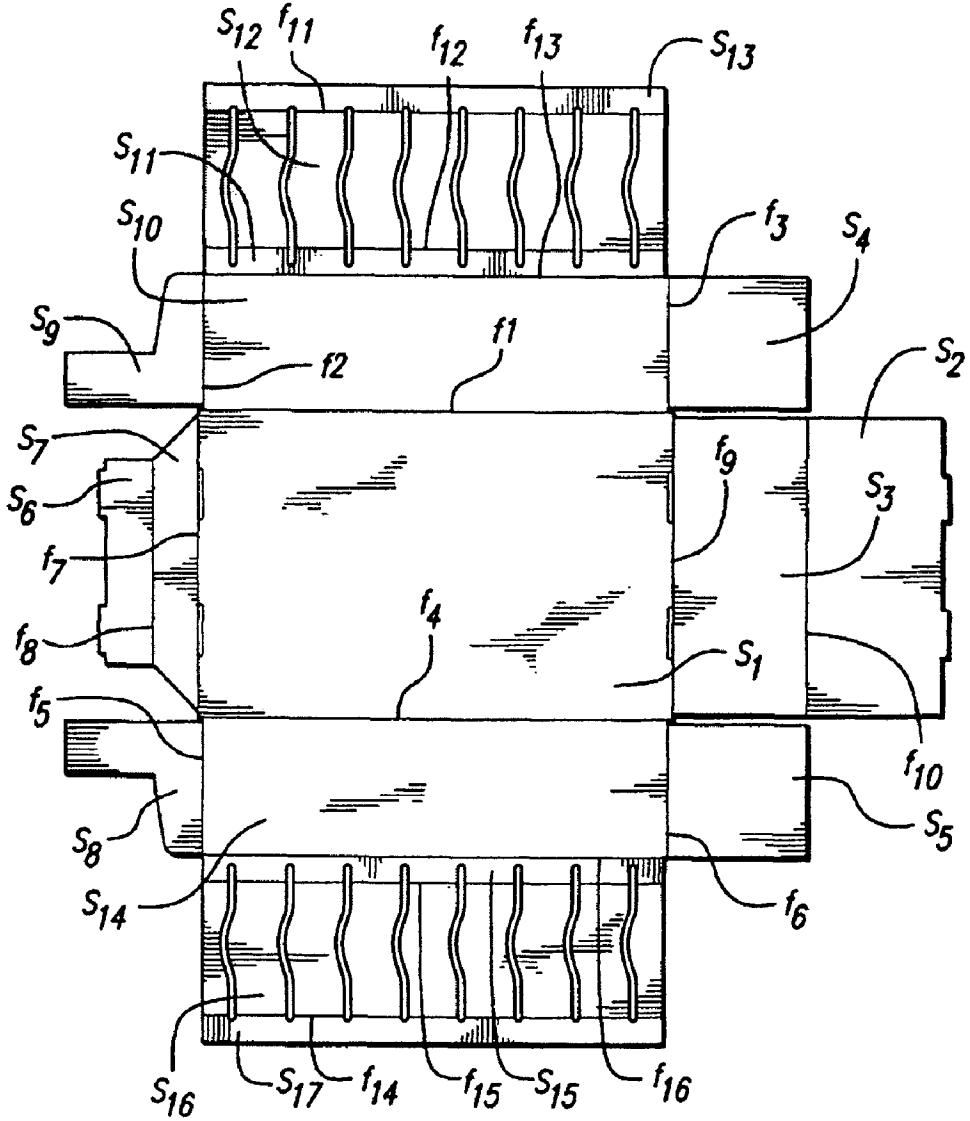
FIG. 2C is a top plan view of the display stand depicted in FIG. 2A, unfolded to reveal its component sections.

As seen in FIGS. 2A-2C, the display stand is preferably constructed from a single, unitary sheet of cardboard or the like, preferably E-flute or F-flute corrugated cardboard. The sheet includes 16 fold lines, designated f1-f16 in the figures, that divide the sheet into 17 sections, designated s1-s17 in the figures. The fold lines may be folded in numerical order (i.e., folding fold line f1 first, fold line f2 next, etc.) to construct the display stand. All fold lines are folded 90°, except for fold lines f8 and f10, which are folded 180°. All fold lines are depicted from their interior side, i.e., the sides that will fold to angles less than 180°.

The base panel 30 is formed from section s1. The rear panel 34 includes an inner layer formed from section s2, an outer layer formed from section s3, and a two-part intermediate layer formed from sections s4 and s5. Similarly, the front panel 32 includes an inner layer formed from section s6, an outer layer formed from section s7, and a two-part intermediate layer formed from sections s8 and s9. The front panel intermediate layer includes two upstanding portions 60, which extend beyond the inner and outer layers to define the front panel's gap 48.

The sheet includes four sections for each of the two side panels 36, 38. Sections s10, s11, and s12 are the left-side panel's outer wall 54, upper wall 44, and inner wall 50, respectively. The inner wall is spaced from the outer wall by the upper wall and by a spacer bar, formed from section s13. Likewise, sections s14, s15, and s16 are the right-side panel's outer wall, upper wall 46, and inner wall, respectively. The inner wall is spaced from the outer wall by the upper end, and by a spacer bar, formed from section s17.

Each display pack 14, as depicted in FIGS. 3A and 3B, is an approximately planar assembly formed from a front portion 64 and a rear portion 66 of vacuum-molded plastic, or the like. The front and rear portions are each configured with a flange 68, 70, respectively, forming a notch that extends around the periphery of the respective portion. The front and rear portions' notched flanges conform to each other to allow the two portions to be adjoined (as seen in FIG. 3B), and further allow the notches to be heat sealed or glued together to form the display pack.

The front and rear portions 64, 66 are each preferably configured with a frame element 72, 74, respectively, protruding from the plane of the portions, around the periphery of the portions, but surrounded by the flanges 68, 70. The frames are configured such that the front and rear portions' frames protrude from the plane of the portion in opposite directions when the two portions are adjoined, as described above.

Additionally, the front and rear portions 64, 66 of the display pack 14 are configured with an indentation 76. The front and rear portions' indentations align to create a product chamber when the two portions are adjoined, as described above. The product chamber is configured to hold the packaged product 18, and is sized to conform to the packaged product, to accommodate both display and shipping requirements. A clear material is used to form the front and rear portions, providing for a product chamber that allows the packaged product it holds to be visible. The product chamber is located centrally within the flanges 68, 70 and the frames 72, 74 of the display pack, which is substantially larger than the packaged product, such that the product is more difficult to steal, and theft is thus deterred. Preferably, the front and rear portions each include flat panels 78, 80 extending between their frames and their indentations.

A flat product display card 82 is located between the front and rear portions 64, 66 of the display pack 14. Preferably the display card extends through the frames 72, 74 to the flanges 68, 70. The display card extends between the flat panels 78, 80, and forms a hole coinciding with the dimensions and location of the indentations 76, so as to accommodate a product 18 in the product chamber.

As seen in FIGS. 1 and 2A-2C, each matched pair 58 of slots 52 is configured to receive any one of the display packs 14, and each display pack is configured such that its flanges 68, 70 may be received in any matched pair of slots in the display stand 12, such that the display pack is supported by the display stand in a position to display the packaged product in the product chamber. The vertically non-linear section 52*a* of each slot is sized relative to the display packs such that the insertion of the planar, vertical edges of the display pack into a matched pair of slots causes the side walls to yieldably deform and thereby more reliably secure the display pack in a desired, upright orientation. This configuration allows the display pack to be supported for attractive display in its desired, substantially upright orientation, despite repeated removal and replacement of the display pack in a matched pair of slots. Preferably, each display pack is supported upright by the side panels, while the display packs adjoin the base panel 30, with their weight resting thereon. However, it is within the scope of the invention to have the side panels provide vertical support to the weight of the display packs.

A plurality of display packs 14 may be inserted into succeeding matched pairs 58 of the display stand's slots 52 to form a fully assembled display assembly. The slots preferably hold the display packs substantially parallel to each other. The frames 72, 74 of the display packs can optionally be configured to adjoin with the frames of adjacent display packs (on either side) to provide structural support to each succeeding display pack. The product chambers of succeeding display packs are configured such that they do not structurally interfere with each other while inserted into the matched pairs of slots.

Figure 4:
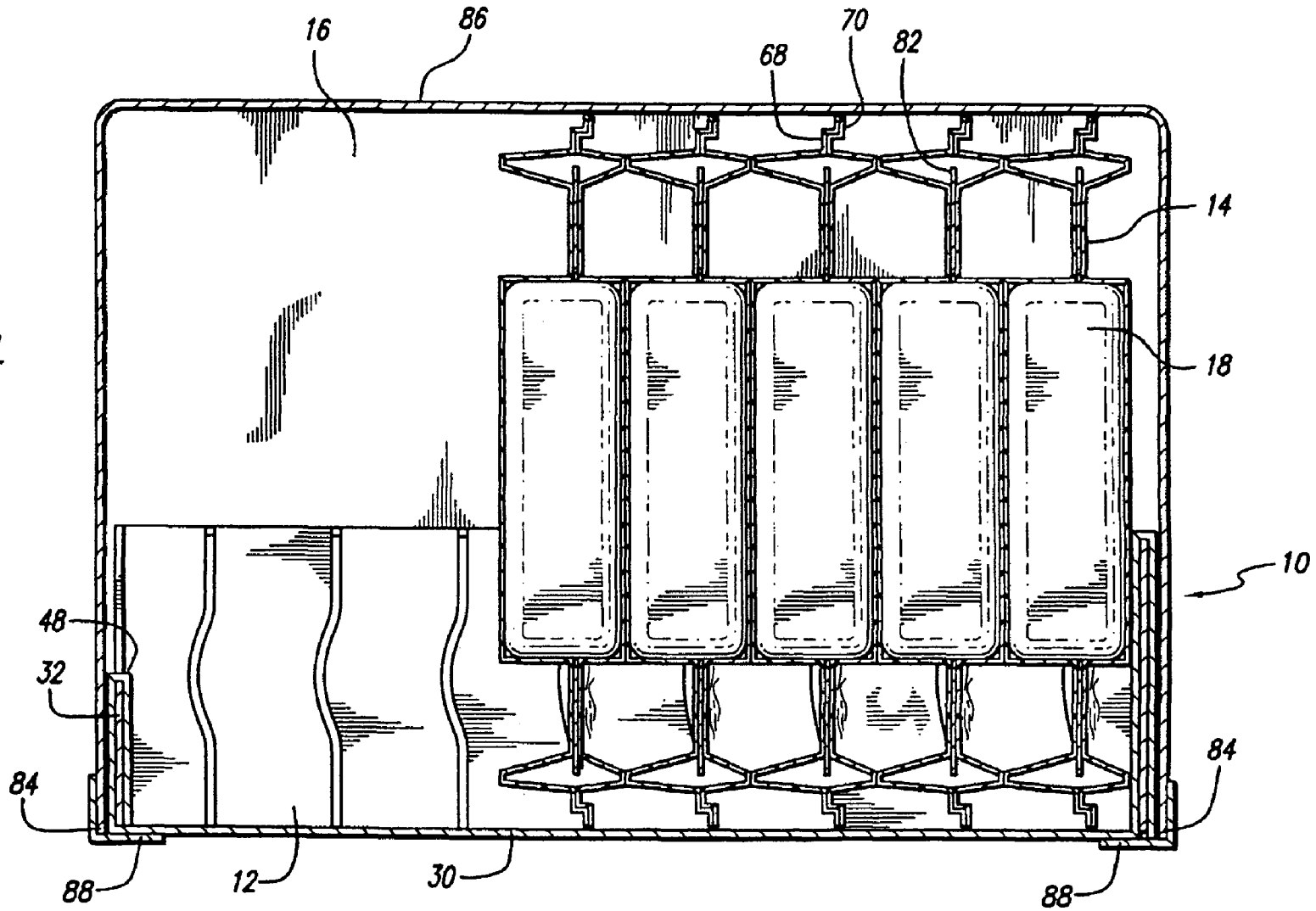
FIG. 4 is a cross-sectional, side elevational view of the packaging assembly depicted in FIG. 1 having three display packs removed.

As seen in FIG. 4, the display stand 12, with the plurality of display packs 14 inserted (three having been left out of the figure for clarity), may be covered with the shipping cover 16 to provide for shipping. The shipping cover is preferably a conventional, five-sided, open-topped, rectangular box that has been inverted such that its rectangular opening 84 is on the bottom. This opening conforms to the shape and size of the base panel 30. The inside of the box defines a cavity configured to receive the assembled display assembly within the cavity such that the opening adjoins the periphery of the base panel.

An inner face of a top panel 86 of the shipping cover 16 adjoins the flanges 68, 70 of the display packs 14 when the shipping cover covers the display stand assembly and the shipping cover's opening 84 adjoins the base panel 30. In this configuration, the shipping cover may be taped, with any appropriate tape 88, along its opening, to the under side of the display stand's base panel to create a structurally sound packaging assembly in the form of a six-sided, rectangular box suitable for shipping. Alternatively, the opening can include flaps, such of the type typical to cardboard boxes. For such a box, the display assembly can be in any orientation within the shipping cover, and the flaps are closed and sealed rather than the shipping cover being taped to the under side of the display stand's base panel.

In the packaging assembly 10, the packaged products 18 are suspended in the product chambers, significantly protecting them from damage during severe shipping accidents. The display packs 14 internally provide vertical and lateral support to the rest of the packaging assembly by partially carrying loads between the display stand 12 and the shipping cover 16. In the case of a shipping cover with the shipping cover taped to the underside of the display stand's base panel, the display packs carry the loads between the display stand and an inner face of the shipping cover panel opposite the display stand (with respect to the display packs).

After the fully assembled packaging assembly 10 has been shipped, the tape may be cut with a knife around the opening 84 to allow the shipping cover 16 to be removed. After removal, the display stand assembly is ready for immediate product display. Normal shipping markings and minor shipping damage will only have affected the shipping cover and underside of the base panel 30 (which is not seen in normal use), and thus the appearance of the display assembly will not be degraded by the packaging and shipping.

On display, the gap 48 in the display stand's front panel 32 provides for improved viewing of the display packs 14. The display packs, while having an appealing shape, and preferably having a display card 82 to augment their appearance, display the packaged products 18 in full view, allowing the aesthetics of, and information on, the packaged products to encourage consumers to purchase the products.

Figure 5:
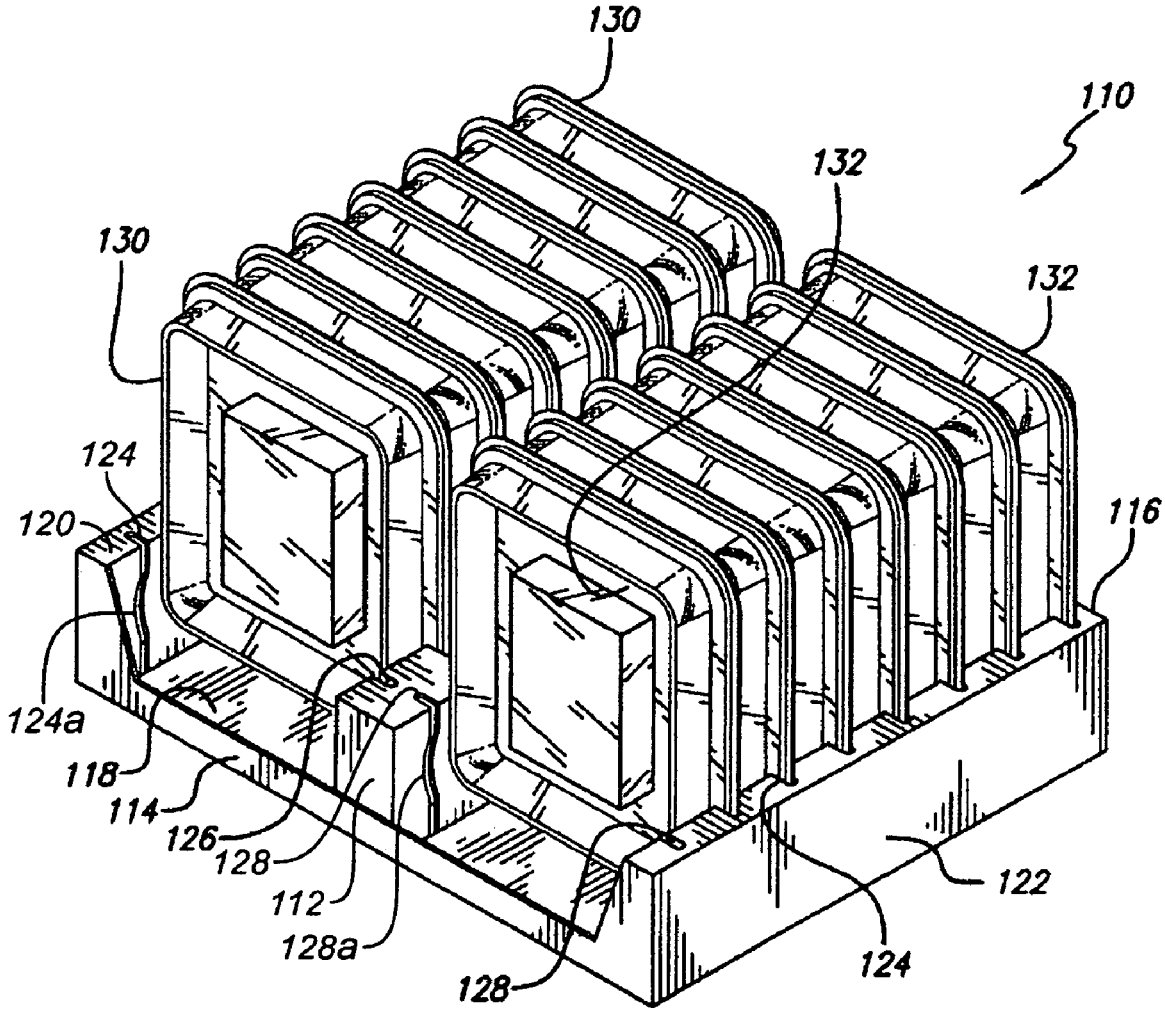
FIG. 5 is a perspective view of portions of a second embodiment of a packaging assembly embodying features of the present invention.

Portions of a second embodiment of a packaging assembly 110 according to the present invention are shown in FIG. 5. The embodiment generally includes the features depicted and described in the first embodiment, with the exception of the features described below.

The second embodiment includes an insert 112 extending from the front panel 114 to the rear panel 116, symmetrically located on the base panel 118. As in the first embodiment, each side panel 120, 122 defines a plurality of slots 124, each having a vertically non-linear section 124*a*. Each slot in the side panels has a matched slot 126 in the insert, with a matching vertically non-linear section 126*a*, thus forming matched pairs 128 of slots.

A first plurality of display packs 130, each being configured to hold one or more products, are configured to be inserted in the slots 124 of the left-side panel 120 and their matched insert slots 126, thus forming one row of display packs in the packaging assembly 110. A second plurality of display packs 132, each being configured to hold one or more products, are configured to be inserted in the slots of the right-side panel 122 and their matched insert slots, thus forming a second row of display packs in the packaging assembly.

While the insert 112 is preferably unitary, with symmetrically placed slots 126, it may be subdivided into sections, and have slots intermittently placed on alternate sides. Furthermore, there may be more than one insert running from the front panel 114 to the rear panel 116. A packaging assembly that includes two inserts running from the front panel to the rear panel could hold three rows of display packs, the third row being inserted in matched pairs of slots between the two inserts.

Either of the two embodiments above, with their shipping covers attached, are preferably sized such that a plurality of the packaging assemblies will fit evenly onto a standard sized shipping pallet (not shown) without having excess palate space left over. With the added package strength provided by the inventive packaging assembly, multiple layers of packaging assemblies may be stacked up and wrapped for shipping.

From the foregoing description, it will be appreciated that the present invention provides for economical bulk-shipping packaging, which includes good protection from product damage and which is configured to maintain the products' display packs in an attractive, upright orientation despite their repeated removal and replacement by customers.

While a particular form of the invention has been illustrated and described, it will be apparent that various modifications can be made without departing from the spirit and scope of the invention. Thus, although the invention has been described in detail with reference only to the preferred embodiments, those having ordinary skill in the art will appreciate that various modifications can be made without departing from the invention. Accordingly, the invention is not intended to be limited, and is defined with reference to the following claims.

What is claimed is:

1. A packaging assembly for shipping and displaying a plurality of products, comprising:

a plurality of display packs, each display pack configured to hold at least one of the plurality of products; and a display stand including a base panel having a left edge and a right edge, a left side panel projecting upward from the base panel's left edge, and a right side panel projecting upward from the base panel's right edge, wherein the left and right side panels each define a plurality of slots, the slots of the left side panel cooperating with the slots of the right side panel to form a plurality of matched pairs of slots, wherein each matched pair of slots is sized and configured to receive and retain at least one of the plurality of display packs, and wherein at least one slot of each of the plurality of matched pairs of slots includes a vertically non-linear section configured such that the insertion of a display pack into the matched pair of slots causes the side wall defining the vertically non-linear section to yieldably deform and thereby retain the display pack in a desired, upright orientation.

2. The packaging assembly of claim 1, wherein the plurality of display packs all are sized and configured to project above the upper ends of the left and right side panels when the display packs are received in matched pairs of slots defined in the side panels.

3. The packaging assembly of claim 1, wherein each slot includes a vertically non-linear section configured such that the insertion of a display pack into the matched pair of slots causes the side walls defining both vertically non-linear sections to yieldably deform and thereby retain the display pack in a desired, upright orientation.

4. The packaging assembly of claim 3, wherein the vertically non-linear sections of all of the plurality of matched pairs of slots have a smoothly curved shaped.

5. The packaging assembly of claim 3, wherein each of the plurality of slots defined in the left and right side panels further includes an upper vertical section located above the vertically non-linear section and a lower vertical section located below the vertically non-linear section.

6. The packaging assembly of claim 5, wherein:

each of the plurality of slots defined in the left and right side panels has a prescribed, substantially uniform horizontal width; and the vertically non-linear section of each slot deviates from vertical by a horizontal distance less than the slot's prescribed, substantially uniform horizontal width.

7. The packaging assembly of claim 6, wherein each slot's prescribed, substantially uniform horizontal width is substantially the same as the thickness of the portion of the display pack that is received and retained by the matched pair of slots.

8. The packaging assembly of claim 3, wherein:

the base panel, left side panel, and right side panel of the display stand all are defined by a single, unitary sheet of folded cardboard;

the left side panel includes an outer wall, an upper wall, and an inner wall, and the plurality of slots defined in the left side panel are located in the panel's inner wall and upper wall; and the right side panel includes an outer wall, an upper wall, and an inner wall, and the plurality of slots defined in the right side panel are located in the panel's inner wall and upper wall.

9. The packaging assembly of claim 8, wherein the sheet of folded cardboard is E-flute or F-flute corrugated cardboard, configured such that the flutes are oriented substantially horizontally in the left and right side panels.

10. A packaging assembly for shipping and displaying a plurality of products, comprising:

a plurality of display packs, each display pack configured to hold at least one of the plurality of products; and a display stand including a base panel having a left edge and a right edge, a left side panel projecting upward from the base panel's left edge, and a right side panel projecting upward from the base panel's right edge, wherein the base panel, left side panel, and right side panel of the display stand all are defined by a single, unitary sheet of folded cardboard, wherein the sheet of folded cardboard is E-flute or F-flute corrugated cardboard, configured such that the flutes are oriented substantially horizontally in the left and right side panels, wherein the left side panel and right side panel each includes an outer wall, an upper wall, and an inner wall, wherein the left and right side panels each define a plurality of slots, the slots of the left side panel cooperating with the slots of the right side panel to form a plurality of matched pairs of slots, wherein the plurality of slots defined in the left side panel are located in the panel's inner wall and upper wall, and the plurality of slots defined in the right side panel are located in the panel's inner wall and upper wall, wherein each matched pair of slots is sized and configured to receive and retain at least one of the plurality of display packs, wherein each slot includes a vertically non-linear section configured such that the insertion of a display pack into the matched pair of slots causes the side walls defining both vertically non-linear sections to yieldably deform and thereby retain the display pack in a desired, upright orientation, wherein the vertically non-linear sections of all of the plurality of matched pairs of slots have a smoothly curved shaped, wherein each of the plurality of slots defined in the left and right side panels further includes an upper vertical section located above the vertically non-linear section and a lower vertical section located below the vertically non-linear section, wherein each of the plurality of slots defined in the left and right side panels has a prescribed, substantially uniform horizontal width, and wherein the vertically non-linear section of each slot deviates from vertical by a horizontal distance less than the slot's prescribed, substantially uniform horizontal width;

wherein the plurality of display packs all are sized and configured to project above the upper ends of the left and right side panels when the display packs are received in matched pairs of slots defined in the side panels.

* * * * *